US005425167A

United States Patent [19]

Shiga et al.

[11] Patent Number: 5,425,167

[45] Date of Patent: Jun. 20, 1995

[54] METHOD OF MAKING A TRANSFORMER FOR MONOLITHIC MICROWAVE INTEGRATED CIRCUIT

[75] Inventors: Nobuo Shiga; Kenji Otobe, both of Kanagawa, Japan

[73] Assignee: Sumitomo Electric Industries, Ltd., Osaka, Japan

[21] Appl. No.: 297,518

[22] Filed: Aug. 29, 1994

Related U.S. Application Data

[63] Continuation of Ser. No. 866,357, Apr. 10, 1992, abandoned.

[30] Foreign Application Priority Data

May 31, 1991 [JP] Japan ..... 3-129669
May 31, 1991 [JP] Japan ..... 3-129673

[51] Int. Cl.[6] ..... H01F 41/06

[52] U.S. Cl. ..... 29/606; 29/602.1; 336/200; 427/116

[58] Field of Search ..... 29/602.1, 606; 336/200; 427/116

[56] References Cited

U.S. PATENT DOCUMENTS 3,290,758 12/1966 Moyer ..... 29/602.1 X
3,561,110 2/1971 Feulner et al. ..... 29/602.1
3,992,691 11/1976 Molthen .
4,253,231 3/1981 Nouet ..... 29/602.1

FOREIGN PATENT DOCUMENTS 3418379 11/1984 Germany .
3423139 1/1985 Germany .
3346659 7/1985 Germany .
3927181 3/1990 Germany .

*Primary Examiner*—Carl E. Hall
*Attorney, Agent, or Firm*—Cushman Darby & Cushman

[57] ABSTRACT

A passive transformer which can be formed in an MMIC having a plurality of first-layer wirings formed on a substrate so that each of the first-layer wirings intersects a desired virtual line on the substrate; an insulating film for covering a substrate surface on which the first-layer wirings are formed; and a plurality of second-layer wirings formed on the insulating film so that each of the second-layer wirings intersects the virtual line and has opposite ends respectively connected to different ends of the first-layer wirings through contact holes. An inductor element having a spiral structure along the virtual line constitutes the first-layer wirings the contact holes and the second-layer wirings. The opposite ends of the inductor element are primary electrodes, and one end and a desired intermediate point of the inductor element are secondary electrodes. Because the transformer has such a structure, a three-dimensional coil can be formed on the substrate so that the transformer can be formed in an MMIC.

2 Claims, 4 Drawing Sheets

METHOD OF MAKING A TRANSFORMER FOR MONOLITHIC MICROWAVE INTEGRATED CIRCUIT

This is a continuation of application Ser. No. 07/866,357, filed on Apr. 10, 1992, which was abandoned upon the filing hereof.

BACKGROUND OF THE INVENTION

The present invention relates to a transformer for performing impedance transformation or for performing separation of a ground circuit in a microwave integrated circuit. The transformer includes an inductor element formed on a substrate which is used for blocking (shunting) or passing a high frequency signal or for constituting a filter in combination with a capacitance element and/or a resistor element, for processing a high-frequency signal of from several hundreds MHz to several tens GHz.

With rapid advances in the development of information network systems, satellite communication system in a high frequency band are becoming more popular. As a result, a high-frequency field-effect transistor, a Schottky barrier type field-effect transistor (MESFET) using a compound semiconductor such as a GaAs semiconductor or the like is being used more and more. Recently, in order to reduce the size and cost of the system for such communication and in order to improve system performance, a first-stage amplifier portion of a down converter for converting a high-frequency signal into a low-frequency signal has been developed and fabricated into an integrated circuit (MMIC: monolithic microwave integrated circuit). The MMIC provides a communication device replacing one constituted by a large number of separate elements. The use of such an MMIC reduces the number of parts, the mounting costs and improves reliability by reducing the number of connection points required by the circuit. Compared with prior devices using a large number of separate elements, reduction in cost can be easily achieved.

Although it is required that a transformer for performing impedance transformation or performing separation of a ground circuit be provided in the form of a MMIC, in a conventional MMIC, an active element has been used to perform the transformer function. The use of these active elements such as an inductor element using a distributed constant line element and a spiral inductor, however, create problems. For example, when using the distributed constant line element such as a micro strip line, there is a tendency for the area of the strip line to become large. This tendency becomes significant in a MMIC for use at low frequencies. As the size of the MMIC chip becomes large, production yield becomes low and the number of chips which can be obtained from a semiconductor substrate becomes relatively smaller, thus, increasing the cost per chip. In the case of a spiral inductor constituted by spirally shaping a line with a width of about 2 μm–about 20 μm, it becomes impossible to form a transformer in view of the inductor structure. Accordingly, a transformer cannot be effectively achieved by using an active element.

The pseudo transformer using an active element reduces the size of the MMIC but increases electric power consumption. Therefore, it is not always desirable to use an active element.

SUMMARY OF THE INVENTION

It is an object of the present invention to provide a passive transformer which can be used in a conventional MMIC and which overcomes the problems stated above. In accordance with the principles of the present invention a transformer provided with a plurality of first-layer wirings formed on a substrate so that each of the first-layer wirings intersects a desired virtual line on the substrate; an insulating film for covering a substrate surface on which the first-layer wirings are formed; and a plurality of second-layer wirings formed on the insulating film so that each of the second-layer wirings intersects the virtual line and has opposite ends respectively connected to different ends of the first-layer wirings through contact holes. An inductor element having a spiral structure along the virtual line is constituted by the first-layer wirings, the contact holes and the second-layer wirings. Opposite ends-of the inductor element are made to be primary electrodes, and one end and a desired intermediate point of the inductor element are made to be secondary electrodes. Further, each of the second-layer wirings has one end connected to one of the first-layer wirings and the other end connected to the n-th (n being a natural number not smaller than 2) order first-layer wiring counted from the one first-layer wiring, whereby n combinations of inductor elements are constituted along one and the same virtual line by the first-layer wirings, the contact holes and the second-layer wirings. The opposite ends of one of the inductor elements are made to be primary electrodes and the opposite ends of other inductor elements are made to be secondary electrodes.

It is a further object of the invention to provide an inductor element for use in an MMIC which reduces the size of the MMIC, and which is easy to manufacture.

In accordance with the present invention, a three-dimensional inductor element is constituted on a substrate by first-layer wirings, second-layer wirings and contact holes connecting the first-and second-layer wirings. The inductance value of the inductor element according to the present invention can be calculated in the same manner as an ordinary solenoid. That is, the self inductance $L_1$ of a sufficient long solenoid having a sectional area $S_1$, a length (length along the virtual line) $l_1$ and the number of turns $n_1$ per unit length can be calculated as follows.

$$L_1=\mu_0 n_1^2 l_1 S_1 \quad (1)$$

Although this equation is an expression for calculating the self inductance of a solenoid of an air-core (with a specific permeability of $\mu_0$), the self inductance of a solenoid having a specific permeability $\mu$ can be calculated as follows.

$$L_1=\mu_0 \mu n_1^2 l_1 S_1 \quad (2)$$

Because the inside of the solenoid according to the present invention cannot be perfectly filled with the magnetic substance, the self inductance thereof can be calculated as follows.

$$L_1={}_0 K n_1^2 l_1 S_1 \quad (3)$$

where $1<K<\mu$

Since a three-dimensional inductor element (coil) is formed on a semiconductor substrate, a transformer can be formed in the same manner as a transformer formed as a separate part.

DETAILED DESCRIPTION OF THE INVENTION

Figure 1:
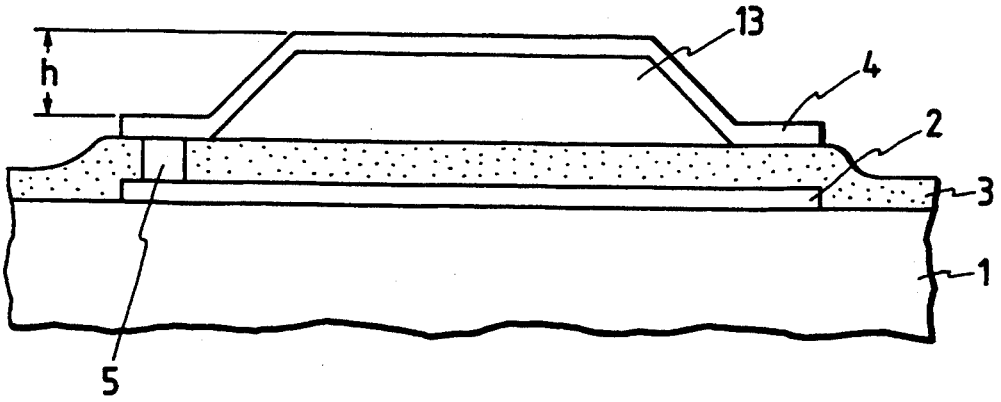
FIG. 1 is a sectional view of a transformer as an embodiment of the present invention.
Figure 2:
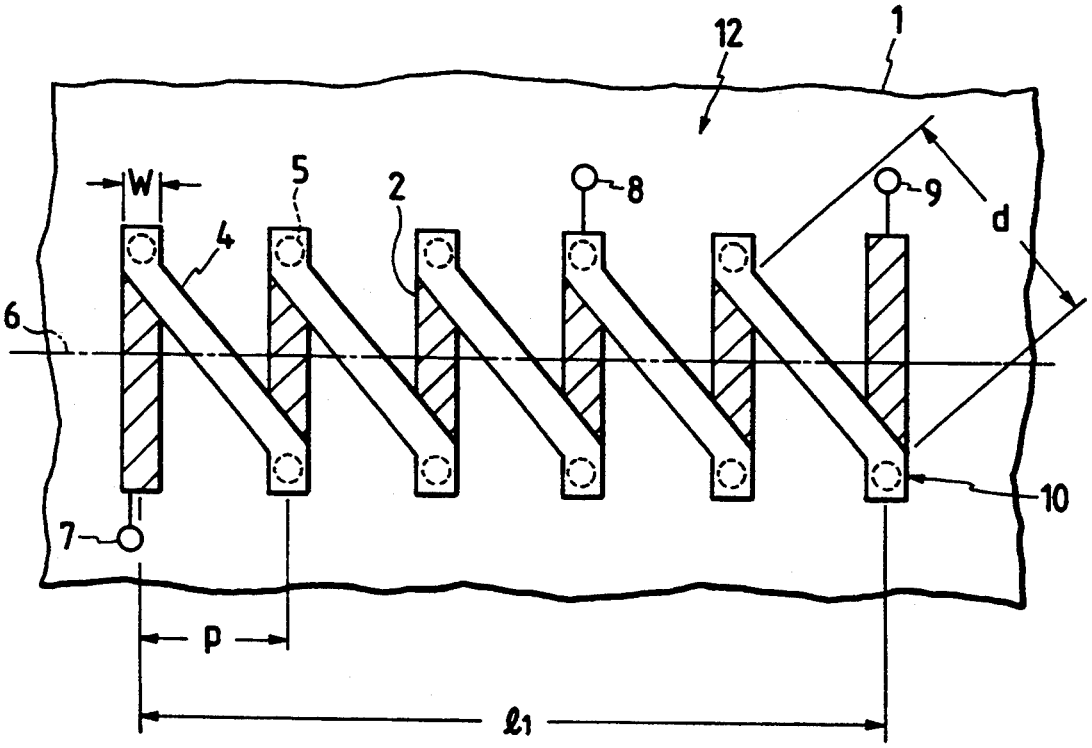
FIG. 2 is a plan view of a transformer as an embodiment of the present invention.
Figure 3:
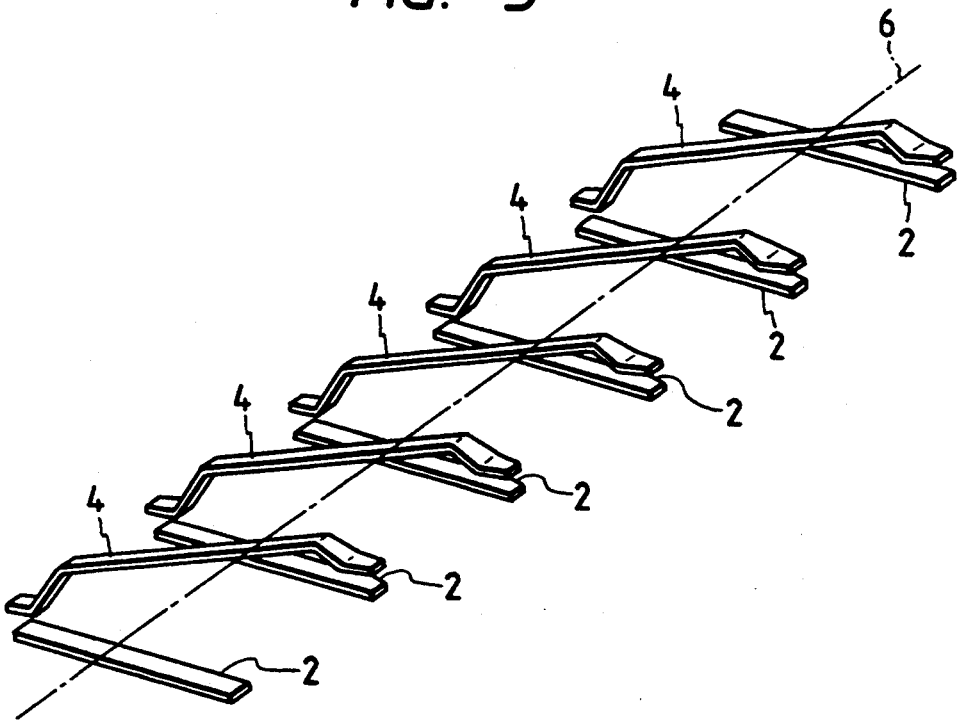
FIG. 3 is a perspective of a transformer as an embodiment of the present invention.

As shown in FIGS. 1–3, a plurality of first wirings 2 each having a rectangular shape which is, for example, 2 μm wide and 50 μm long, are arranged along a desired virtual line 6 on a semi-insulating semiconductor substrate 1 so that the first wirings 2 intersect the virtual line 6. A metal such as Ti/Au or the like is used for the first-layer wirings 2 and the thickness thereof is 0.5 μm–1 μm.

Then, an inter-layer insulating film 3 ordinarily having a thickness of several thousands angstroms is formed of $Si_3N_4$, SiON or the like. Thereafter, through-holes are formed by etching by removing portions corresponding to contact holes 5 from the inter-layer insulating film 3.

Next, a photoresist is applied to be as thick as possible, provided that exposure and development can occur. If the type of photoresist and condition for applying the photoresist are suitably selected, the photoresist can be applied to a thickness of about 20 μm. The photoresist is then removed at the portions corresponding to the contact holes 5 by exposure and development, so that second-layer wirings 4, which will be formed later, can be electrically connected to the first-layer wirings 2. After the completion of the patterning, the shape at the upper end portions of the photoresist is made round by baking at a temperature of about 140° C. The baking is to make the throwing power good in forming the conductors of the second-layer wirings 4. Next, a metal such as Ti/Au or the like is formed by evaporating deposition or sputtering and then Au is deposited thereon by plating, thereby forming the second-layer wirings 4. The thickness of the second-layer wirings 4 is ordinarily selected to be 2 μm–3 μm.

After the second-layer wirings 4 have been formed as described above, the photoresist is removed so that a hollow air bridge 13 is formed between the first-layer wirings 2 and the second-layer wirings 4. However, the inter-layer insulating film 3 is left as is on the first-layer wirings 2.

Through the aforementioned steps, an inductor element 10 is formed having a spiral structure constituted by the first-layer wirings 2, the second-layer wirings 4 and the contact holes 5.

Such an inductor element 10 may be formed even without application of the air bridge technique in the final step. For example, the inter-layer insulating film 3 may be formed to be thicker and then the second-layer wirings 4 may be formed directly thereon. The use of the air bridge technique is, however, advantageous for the following reasons. Because the inductance value increases as the sectional area $S_1$ increases, the area occupied by the inductor element as required for obtaining the same inductance value, becomes smaller, which is apparent from expression (1). Accordingly, size reduction of the MMIC can be achieved by using the air bridge structure to increase the sectional area $S_1$. Further, the distributed capacity becomes smaller not only by increasing the distance between the first-layer wirings 2 and the second-layer wirings 4, but by removing the photoresist as an insulating substance. Accordingly, the self resonance frequency, i.e., the maximum limit frequency allowing this element to use as an inductor element, becomes larger.

An example of calculation of the inductance value of the inductor element 10 in this embodiment will be described hereunder. Although it is advantageous to select the width w of the windings to be smaller because the occupied area decreases as the width w decreases, the resistance of the wirings becomes larger and, accordingly, Q of the inductance becomes smaller. Accordingly, the width must be determined on the basis of the value of Q allowable in accordance with the frequency, inductance or the like to be used, and the resistance of the wirings. It is now assumed that the width is 10 μm. Although it is advantageous to select the height h of the air bridge to be larger, it is apparent from the point of view of supporting strength that the length d of the air bridge in the horizontal direction must be reduced as the height h increases. Therefore, the height h is determined to an optimum value taking the sectional area and the occupied area into consideration. It is now assumed that the height h of the air bridge and the length d of the same are 20 μm and 120 μm, respectively. These are values which can be obtained in practical use. In the case where the width w of the wirings is 10 μm, the pitch p between adjacent wirings can approach about 12 μm. If the pitch is made to sufficiently approach the above-mentioned value, the distributed capacity becomes larger and, accordingly, the self resonance frequency becomes smaller. Accordingly, the pitch p between adjacent wirings is determined on the basis of the self resonance frequency which is allowed.

Next, it is assumed that the pitch p is 15 μm. Here, the inductance value can be calculated proportionally to the number of turns according to the aforementioned expression (1). When, for example, the number of turns is 40 though only five turns are shown in the drawings for the simplification of description, the inductance value is calculated as follows.

$$\mu_0 = 1.2566 \times 10^{-16}$$
$$n_1 = 40/l_1 = 6.67 \times 10^4$$
$$l_1 = 40 \times 15 \times 10^{-6} = 6 \times 10^{-4}$$
$$S_1 = 20 \times 10^{-6} \times 100 \times 10^{-6} = 2 \times 10^{-9}$$
$$L_1 = \mu_0 n_1^2 l_1 S_1 = 6.71K \times 10^{-9}H = 6.71nH$$

In the aforementioned expressions, the sectional is assumed to be a rectangle and the thickness of the inter-layer insulating film is neglected.

According to the Autumn National Meeting C-56, 1990, of the Institute of Electronics, Information and Communication Engineers of Japan, the inductance value becomes 4.8 nH when a plane-type spiral inductor is formed with an area of 300 μm×300 μm.

In the aforementioned example of-calculation, the inductance value is 6.71 nH when the inductor is formed with an occupied area of 600 μm×120 μm. Accordingly, the inductance per unit area of the flat-type spiral inductor is 0.053 pH/μm$^2$ whereas the inductance per unit area of the inductor according to the invention is 0.093 pH/μm$^2$, which is 1.75 times greater. Further, the inductor according to the invention has a long and narrow structure, so that the longitudinal direction (the direction of the virtual line 6 can be bent if necessary. Accordingly, the inductor of the transformer of the invention has an advantage in that the degree of freedom on layout design is too large to form a dead space in the MMIC, compared with the conventional spiral inductor.

The inductor element 10 thus produced is three-dimensional so that it can be dealt with in the same manner as an ordinary coil. Accordingly, when terminals 7, 8 and 9 extend from the opposite ends of the inductor element and a predetermined intermediate point thereof, a transformer 12 is provided using the terminals 7 and 9 as primary electrodes and the terminals 8 and 9 as secondary electrodes.

Figure 4:
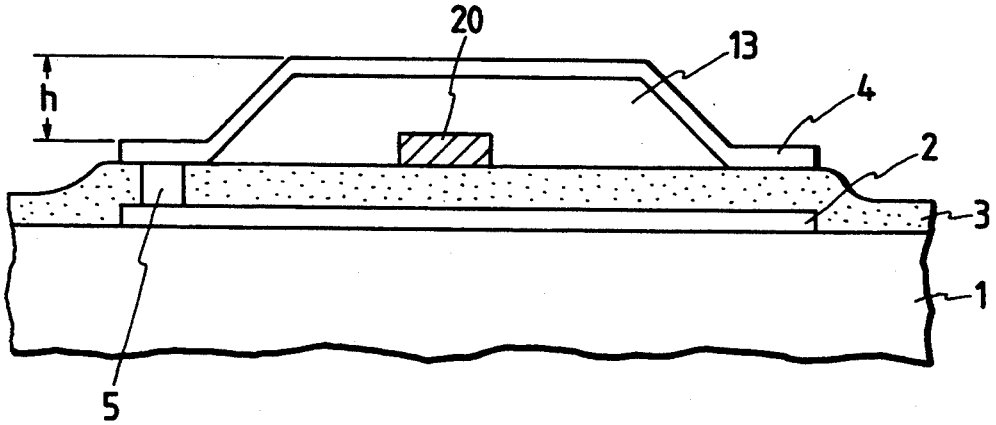
FIG. 4 is a sectional view of a transformer as a second embodiment of the present invention.
Figure 5:
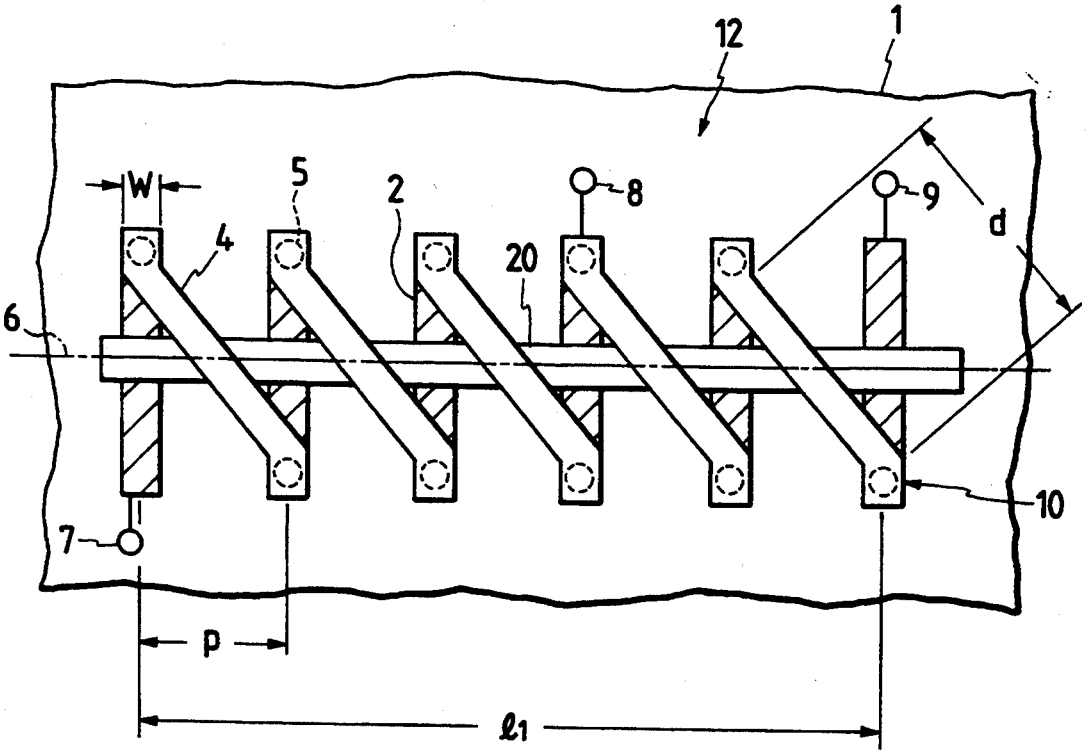
FIG. 5 is a plan view of a transformer as a second embodiment of the present invention.
Figure 6:
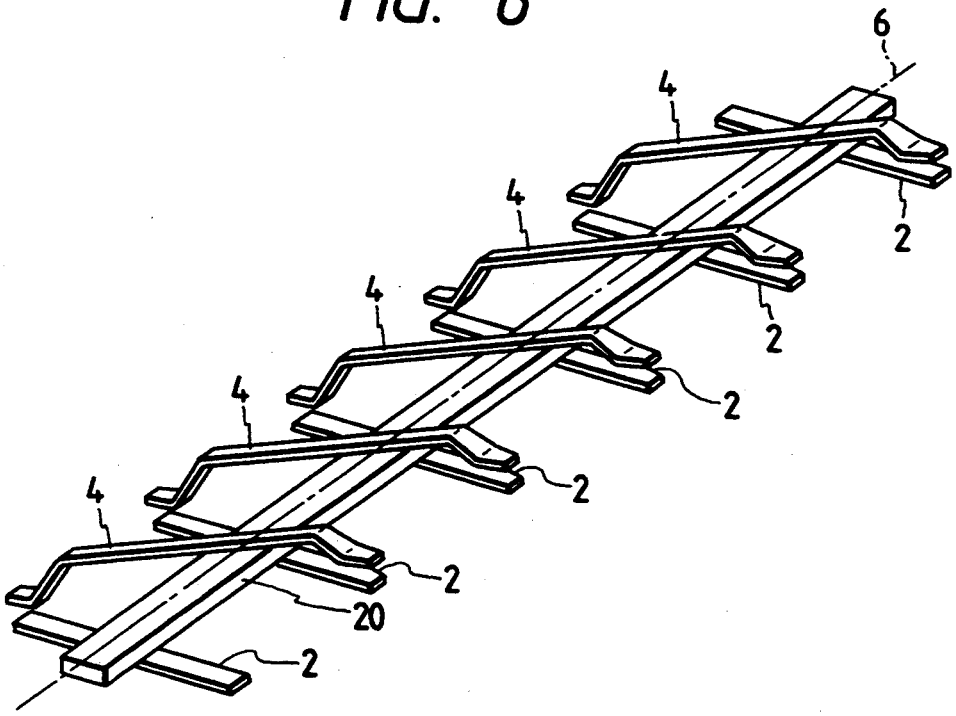
FIG. 6 is a perspective view of a transformer as a second embodiment of the present invention.

A second embodiment of the present invention is shown in FIGS. 4 through 6. The second embodiment is different from the first embodiment in that a belt-like magnetic substance 20 is provided in the spiral structure.

The first-layer wirings 2 and the inter-layer insulating film 3 are formed in the same manner as in the first embodiment. Then, a magnetic material such as Fe, Ni, Co, ferrite or the like is deposited on the inter-layer insulating film 3 by sputtering or the like and then a magnetic core 20 is formed so as to have a belt-like shape. The steps thereafter is substantially the same as in the first embodiment.

In the second embodiment, the expression (3) is used to calculate the inductance value of the inductor element. When the width w of the windings, the height h of the air bridge, the horizontal length d of the air bridge, the pitch p between adjacent wirings and the number of turns are respectively equal to those in the first embodiment, the inductance $L_1$ is calculated as follows.

$$L_1 = \mu_0 K n_1^2 l_1 S_1 = 6.71K \times 10^{-9}\,(H) = 6.71K(nH) \quad (4)$$

Because K is larger than 1, a larger value can be obtained compared with the first embodiment having no magnetic substance (magnetic core) 20. In other words, this embodiment provides a size advantage.

Figure 7:
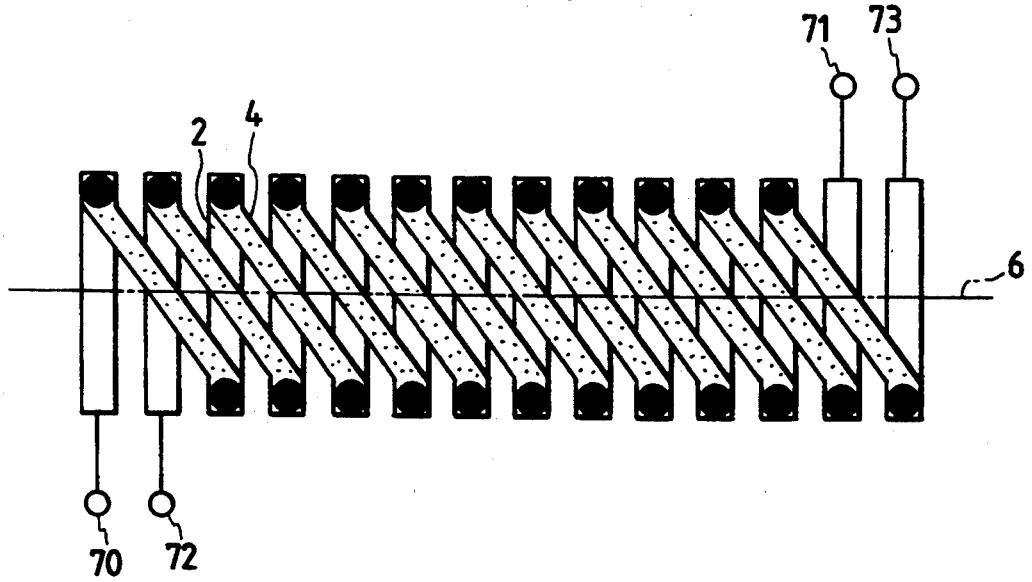
FIG. 7 is a schematic plan view of a transformer as a third embodiment of the present invention.

FIG. 7 shows a further embodiment in which the opposite ends of each of the second-layer wirings 4 are connected to the first-layer wirings 2 at intervals of one first-layer wiring. Accordingly, two combinations of inductor elements are formed coaxially so as to overlap each other coaxially. As a result, a transformer can be formed by using the opposite ends (terminals 70 and 71) of one inductor element as primary electrodes and the opposite ends (terminals 72 and 73) of the other inductor element as secondary electrodes. When the number of first-layer wirings 2 skipped by each of the second-layer wirings 4 is increased in the same manner as described above, three or more combinations of inductor elements can be formed so as to overlap each other coaxially.

Figure 8:
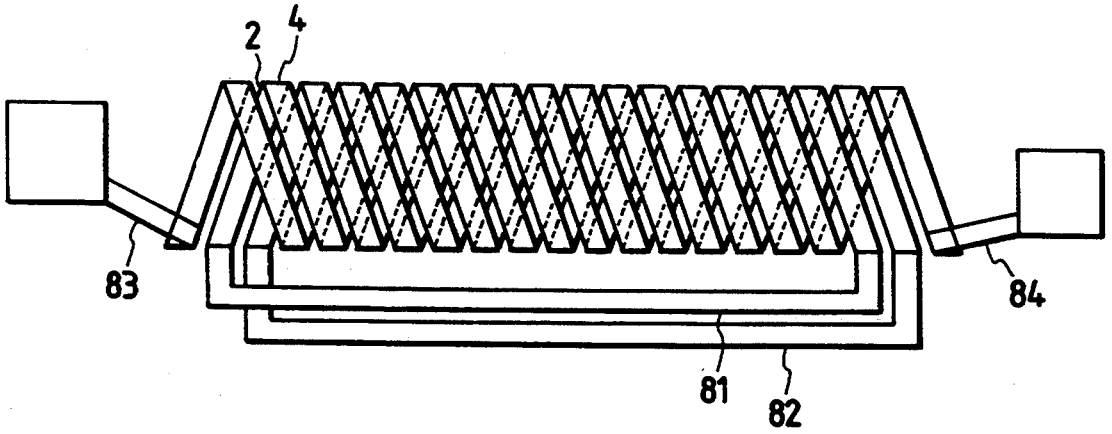
FIG. 8 is a schematic plan view of a transformer wired to form an impedance transformer as a fourth embodiment of the present invention.

The transformer according to the invention is a transmission-line transformer which theoretically has a wide frequency band. Accordingly, when triple-spiral structure inductor elements are connected by wirings 81 to 84 as shown in FIG. 8, it is possible to provide a 1:9 impedance transformer.

As described above, according to the present invention, a passive transformer which has previously not been provided in the conventional MMIC can be formed as an integrated circuit. The transformer includes an inductor element having a long and narrow structure so that it can be bent suitably on the substrate. Accordingly, the inductor element improves the degree of freedom on layout design, as compared with the conventional plane-type spiral inductor.

While the present invention has been described in connection with what is presently considered to be the most practical and preferred embodiments, it is understood that the invention is not limited to the disclosed embodiments, but, on the contrary, is intended to cover various modifications and equivalent arrangements included within the spirit and scope of the appended claims.

What is claimed is:

1. A method of manufacturing a transformer comprising the steps of:

arranging a plurality of first wirings each having first and second ends along a desired virtual line on a semiconductor substrate so that said first wirings intersect with said virtual line;

forming an inter-layer insulating film which covers a substrate surface on which said first wirings are formed;

forming holes through said insulating film which correspond to contact points at each said first and second ends of said first wirings, said virtual line being disposed between said contact points;

applying a photoresist at least over said holes;

removing portions of the photoresist at points corresponding to the contact points by exposure and development;

arranging a plurality of second-layer wirings each having first and second ends so that each of said second layer wirings intersects said virtual line, said first ends of said second layer wirings being respectively connected to said first ends of said first wirings at said contact points, said second ends of said second layer wirings being connected to second ends of different first wirings;

providing an air gap between said first wirings and said second-layer wirings;

providing a magnetic core within said air gap; and forming primary and secondary electrodes at predetermined points.

2. A method of manufacturing an inductor comprising the steps of:

arranging a plurality of first wirings each having first and second ends along a desired virtual line on a semiconductor substrate so that said first wirings intersect with said virtual line;

forming an inter-layer insulating film which covers a substrate surface on which said first wirings are formed;

forming holes through said insulating film which correspond to contact points at each said first and second ends of said first wirings, said virtual line being disposed between said contact points;

applying a photoresist over said holes;

removing portions of the photoresist at points corresponding to the contact points by exposure and development; and arranging a plurality of second-layer wirings each having first and second ends so that each of said second layer wirings intersects said virtual line, said first ends of said second layer wirings being respectively connected to said first ends of said first wirings at said contact points, said second ends of said second layer wirings being connected to second ends of different first wirings;

providing an air gap between said first wirings and said second-layer wirings; and providing a magnetic core within said air gap.

* * * * *